US011381025B2

(12) United States Patent
Chen

(10) Patent No.: US 11,381,025 B2
(45) Date of Patent: Jul. 5, 2022

(54) ELECTRICAL CONNECTOR AND METHOD THEREOF MAKING THE SAME

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventor: Chao-Chieh Chen, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/120,833

(22) Filed: Dec. 14, 2020

(65) Prior Publication Data

US 2021/0184386 A1 Jun. 17, 2021

(30) Foreign Application Priority Data

Dec. 13, 2019 (CN) ..... 201911280222.2

(51) Int. Cl.
*H01R 13/432* (2006.01)
*H01R 13/502* (2006.01)
*H01R 13/24* (2006.01)

(52) U.S. Cl.
CPC ..... *H01R 13/432* (2013.01); *H01R 13/24* (2013.01); *H01R 13/502* (2013.01)

(58) Field of Classification Search
CPC .... H01R 23/722; H01R 9/096; H01R 9/2408; H01R 9/22; H01R 13/514; H01R 13/6586; H01R 13/6587; H01R 13/432; H01R 13/502; H01R 13/24
USPC ..... 439/710, 714, 717, 607.06, 607.07
See application file for complete search history.

(56) References Cited

U.S. PATENT DOCUMENTS

| | | | | |
|---|---|---|---|---|
| 4,871,316 | A * | 10/1989 | Herrell | H01R 12/714 439/66 |
| 10,777,929 | B2 | 9/2020 | Fit | |
| 2002/0086562 | A1 * | 7/2002 | Uratsuji | H05K 7/1069 439/71 |
| 2010/0055933 | A1 * | 3/2010 | Laurx | H01R 13/6477 439/65 |
| 2010/0136844 | A1 * | 6/2010 | Pan | H01R 13/514 439/660 |

(Continued)

*Primary Examiner* — Gary F Paumen
(74) *Attorney, Agent, or Firm* — Ming Chieh Chang; Wei Te Chung

(57) ABSTRACT

An electrical connector includes an insulative housing composed of a plurality of parallel partitions each extending in a longitudinal direction, and plural rows of contact modules each extending in the longitudinal direction and disposed in the housing. Each contact module includes a plurality of contacts integrally formed within an insulator/wafter which extends in a longitudinal direction. In each contact module, each contact includes a main body with opposite contacting arms on upper and lower sections. The contact modules are successively assembled downwardly in the housing by plural assembling poles each of which retainably extends through plural contact modules in the transverse direction and retained in the corresponding positioning grooves formed in the corresponding partitions, respectively.

20 Claims, 12 Drawing Sheets

(56) References Cited

U.S. PATENT DOCUMENTS

| | | | |
|---|---|---|---|
| 2020/0227840 | A1 | 7/2020 | Lotes |
| 2020/0227855 | A1 | 7/2020 | Lotes |

* cited by examiner

ELECTRICAL CONNECTOR AND METHOD THEREOF MAKING THE SAME

BACKGROUND OF THE INVENTION

1. Field of the Invention

The present invention relates to a connector assembly and the manufacturing method thereof, and particularly to the connector having corresponding contacts with a fine pitch contact arrangement and assembled into the housing via a contact module pattern.

2. Description of Related Arts

As shown in US Patent Application Publication No. 2020/0227855, the electrical connector having a plurality of contacts with a strip connecting portion 241 at the bottom for connecting to a lower contact carrier 80, and a connecting portion 25 at an upper portion for connecting to an upper contact carrier 90. Anyhow, because of the side arms 242 of the conducting portion 24 around the strip connecting portion 242, the neighboring contacts 2 cannot be densely arranged with one another with a fine pitch arrangement wherein the contacts 2 are arranged corresponding to every other positioning holes defined in the lower contact carrier 80, thus precluding the miniaturization of the corresponding connector disadvantageously.

Therefore, an improvement to the electrical connector with a fine pitch arrangement of the corresponding contacts and an easy manufacturing method thereof, is desired.

SUMMARY OF THE INVENTION

To achieve the above object, an electrical connector includes an insulative housing composed of a plurality of parallel partitions each extending in a longitudinal direction, and plural rows of contact modules each extending in the longitudinal direction and disposed in the housing. Each contact module includes a plurality of contacts integrally formed within an insulator/wafter which extends in a longitudinal direction. In each contact module, each contact includes a main body with opposite contacting arms on upper and lower sections wherein the contacts in the same contact carrier are originally linked with the neighboring contacts around lateral sides of the main body for insert-molding consideration, and the corresponding linking sections are removed for disconnecting the neighboring the contacts after insert-molding to form the final complete contact module. The contact modules are successively assembled downwardly in the housing by plural assembling poles each of which retainably extends through plural contact modules in the transverse direction and retained in the corresponding positioning grooves formed in the corresponding partitions, respectively.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
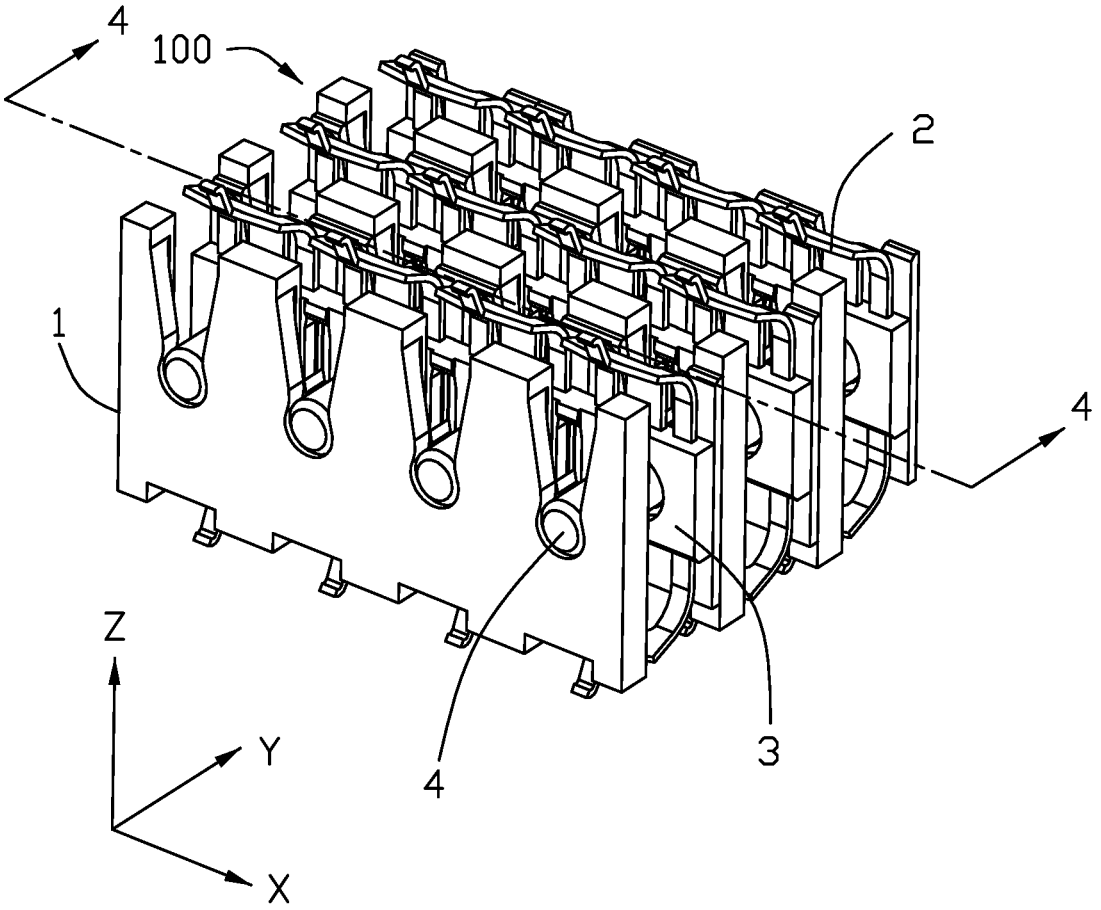
FIG. 1 is a perspective view of an electrical connector according to the invention.
Figure 2:
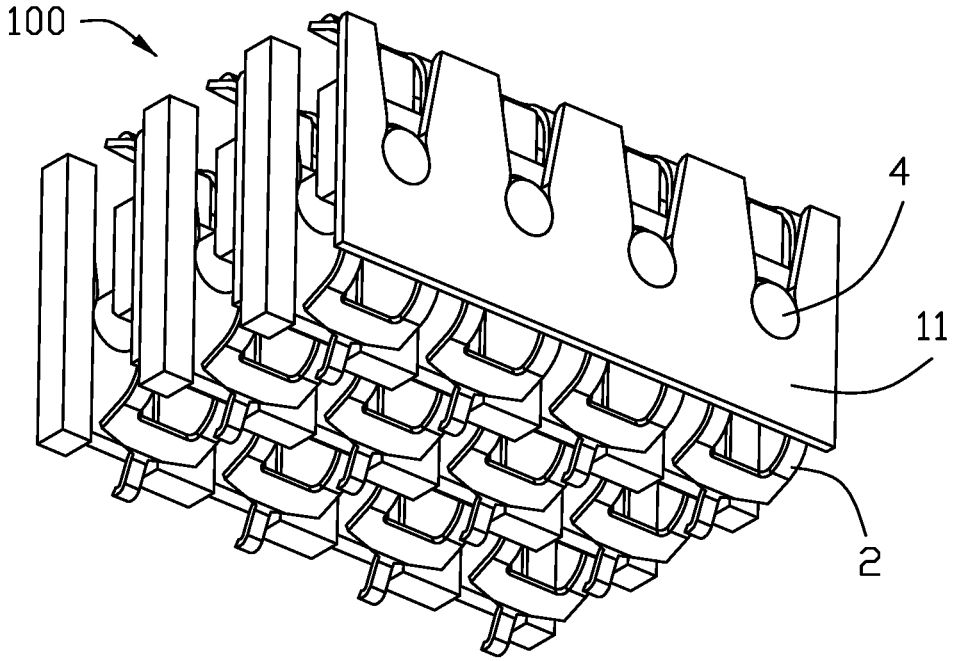
FIG. 2 is another perspective view of the electrical connector of FIG. 1.
Figure 3:
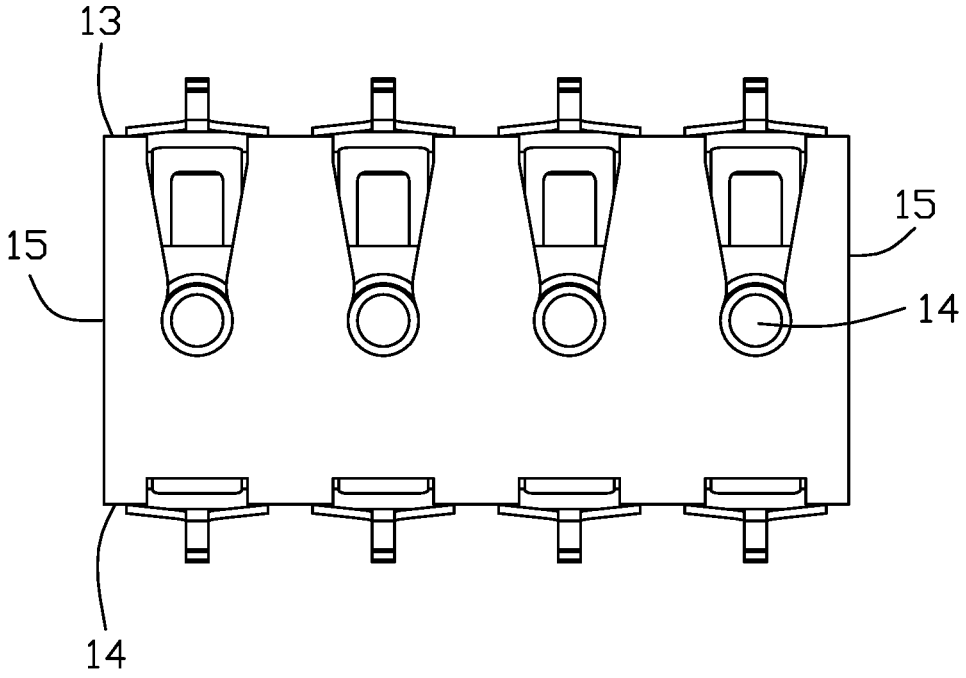
FIG. 3 is an elevational view of the electrical connector of FIG. 1.
Figure 4:
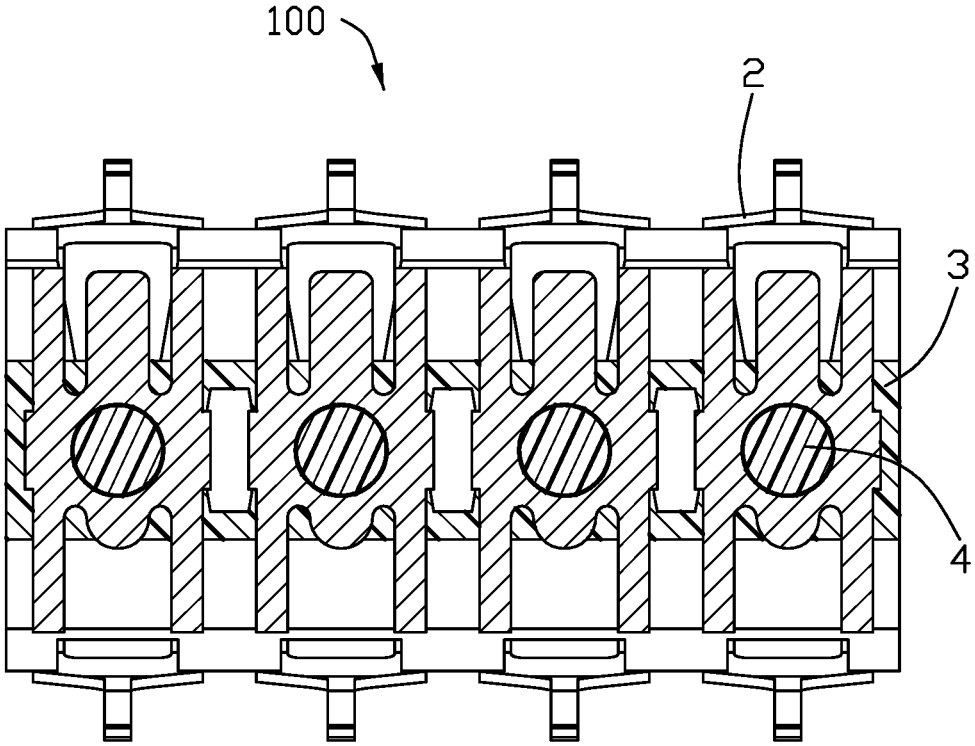
FIG. 4 is a cross-sectional view of the contact module of the electrical connector of FIG. 1.
Figure 5:
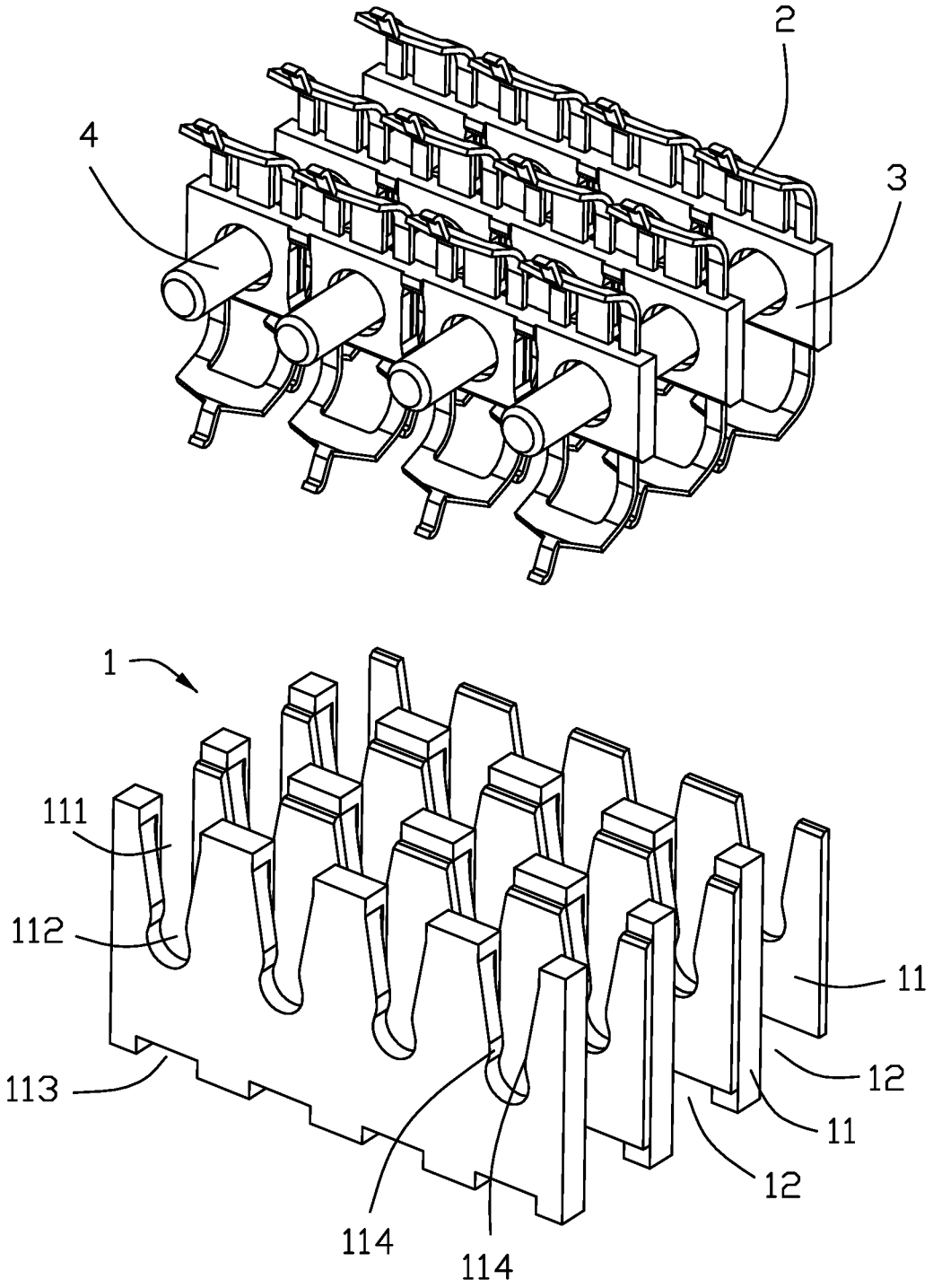
FIG. 5 is an exploded perspective view of the electrical connector of FIG. 1.
Figure 6:
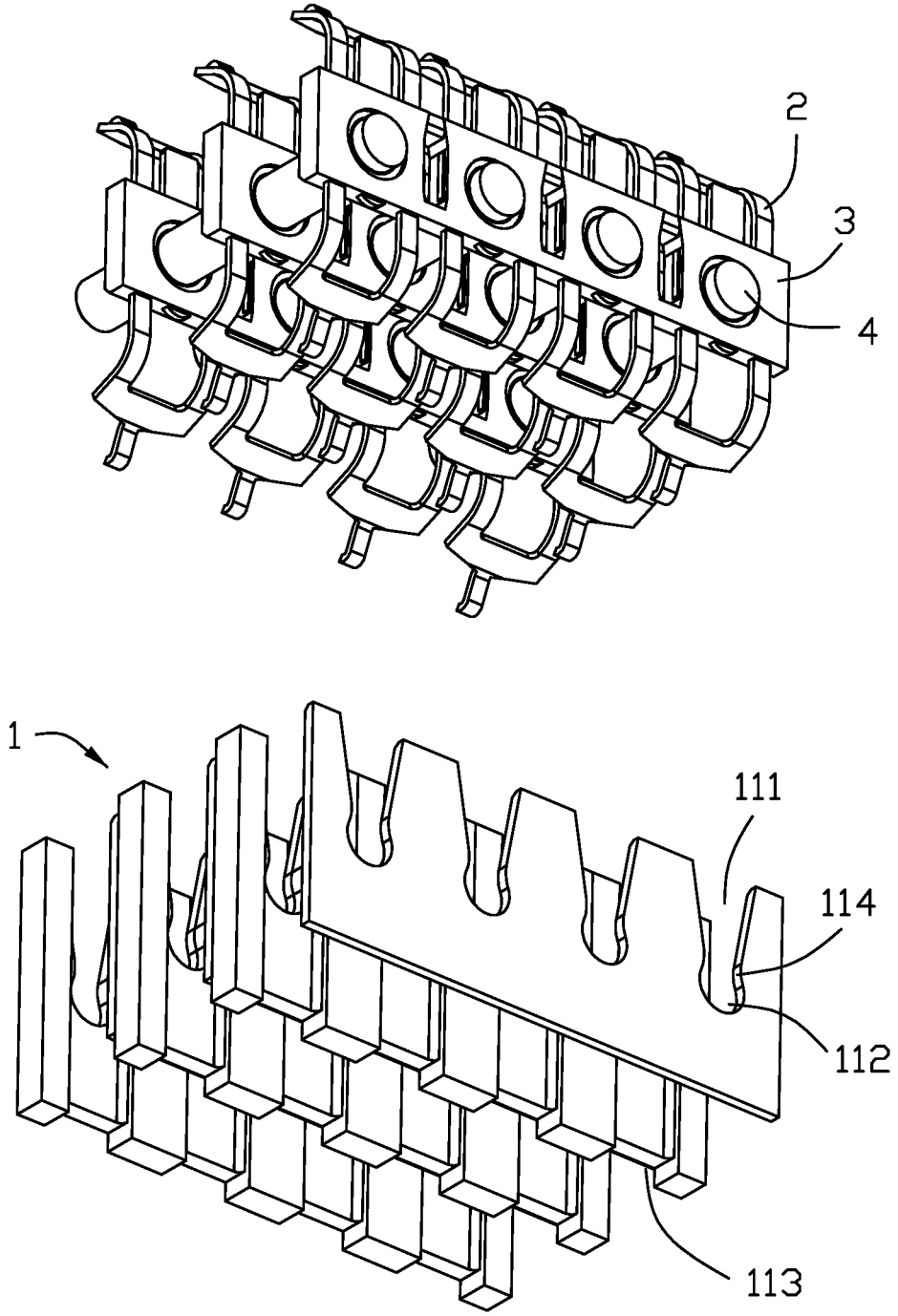
FIG. 6 is another exploded view of the electrical connector of FIG. 5.
Figure 7:
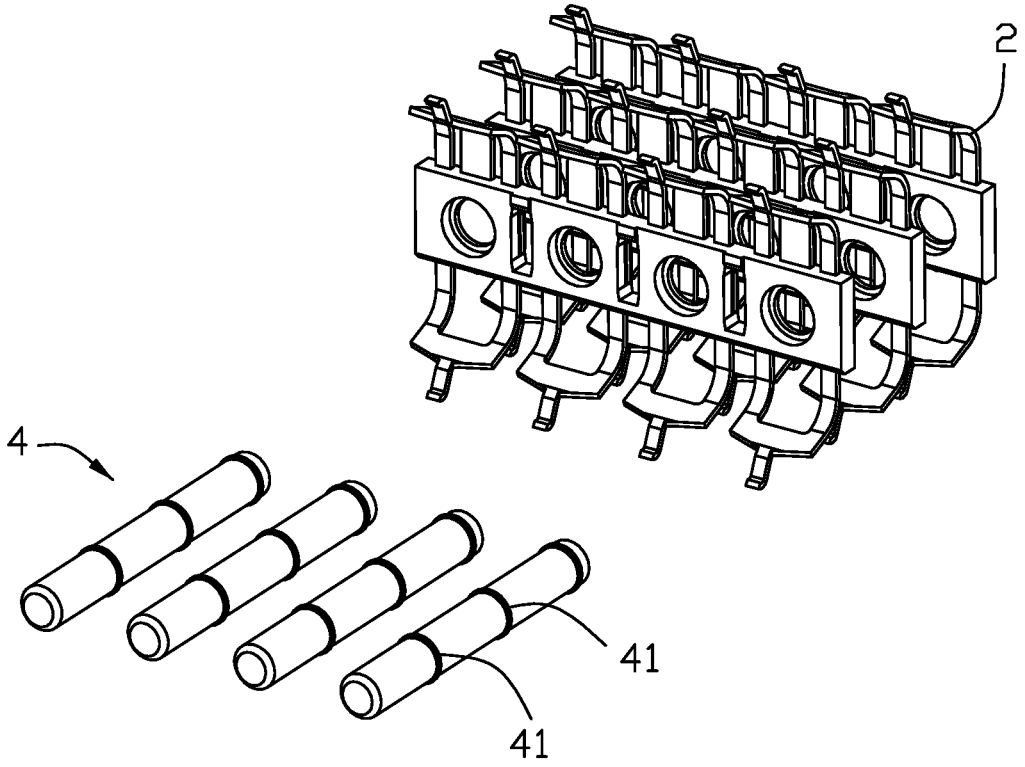
FIG. 7 is an exploded perspective view of the contact module subassembly of the electrical connector of FIG. 1.

Referring to FIGS. 1-12, an electrical connector 100 for mating with an electronic package (not shown), e.g., a chip, includes an insulative housing 1, and a plurality of contact modules (not labeled) retained in the housing 1. Each contact module includes a plurality of contacts 2 integrally formed within an insulator/wafer 3 via insert-molding. In this embodiment, direction X is a longitudinal direction, direction Y is a transverse direction, a direction Z is a vertical direction. All directions X, Y and Z are perpendicular to one another.

The hosing 1 includes a plurality of partitions 11 extending in the longitudinal direction and parallel to one another at equal intervals with corresponding channels 12 each formed between every adjacent two partitions 11. The housing 1 forms opposite top surface 13 and lower surface 14, and two opposite side surfaces 15. The channels extend through the side surfaces 15 in the longitudinal direction and through the opposite top surface 13 and bottom surface 14 in the vertical direction. Each partition 11 forms a plurality of upwardly divergent guiding slots 111 each with a positioning slot 112 at a bottom end, and a cutout 113 upwardly recessed from the lower surface 14. A pair of protrusions 114 are formed on a joint between the guiding slot 111 and the positioning slot 112.

Figure 8:
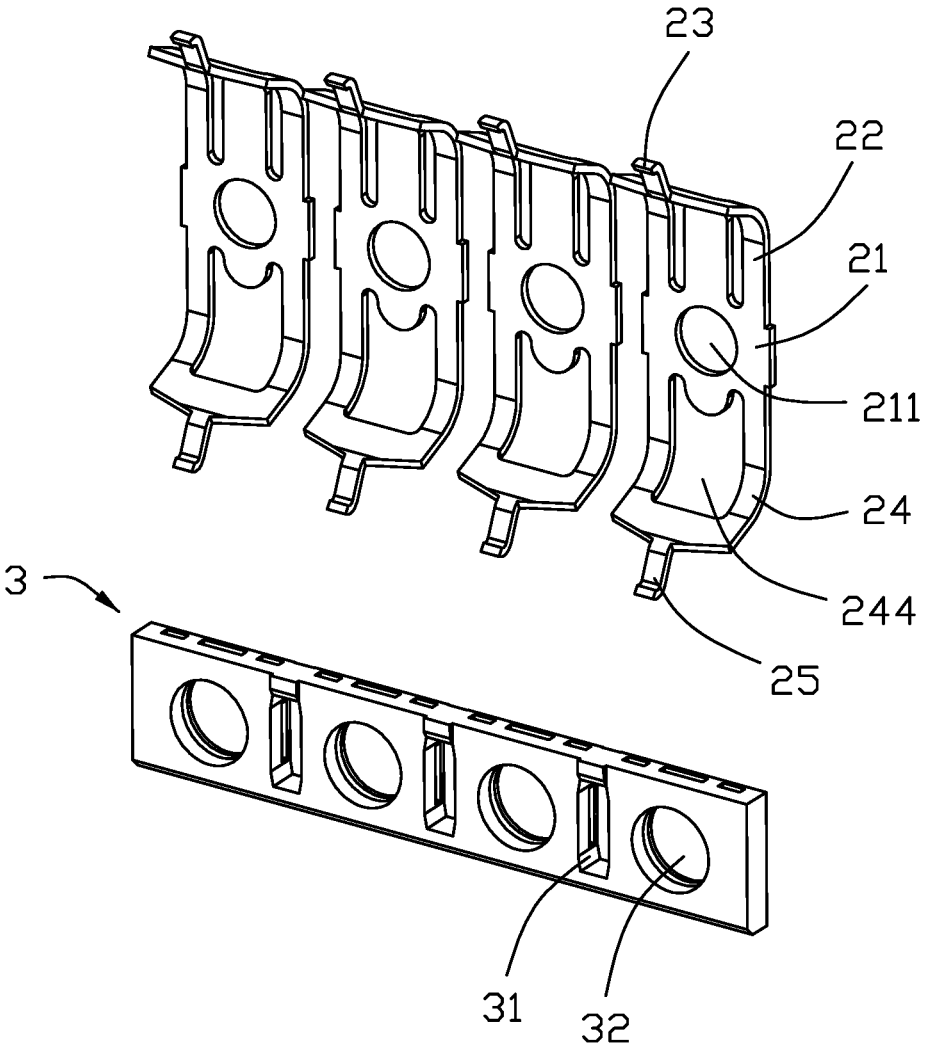
FIG. 8 is an exploded perspective view of the contact module of the electrical connector of FIG. 7.
Figure 9:
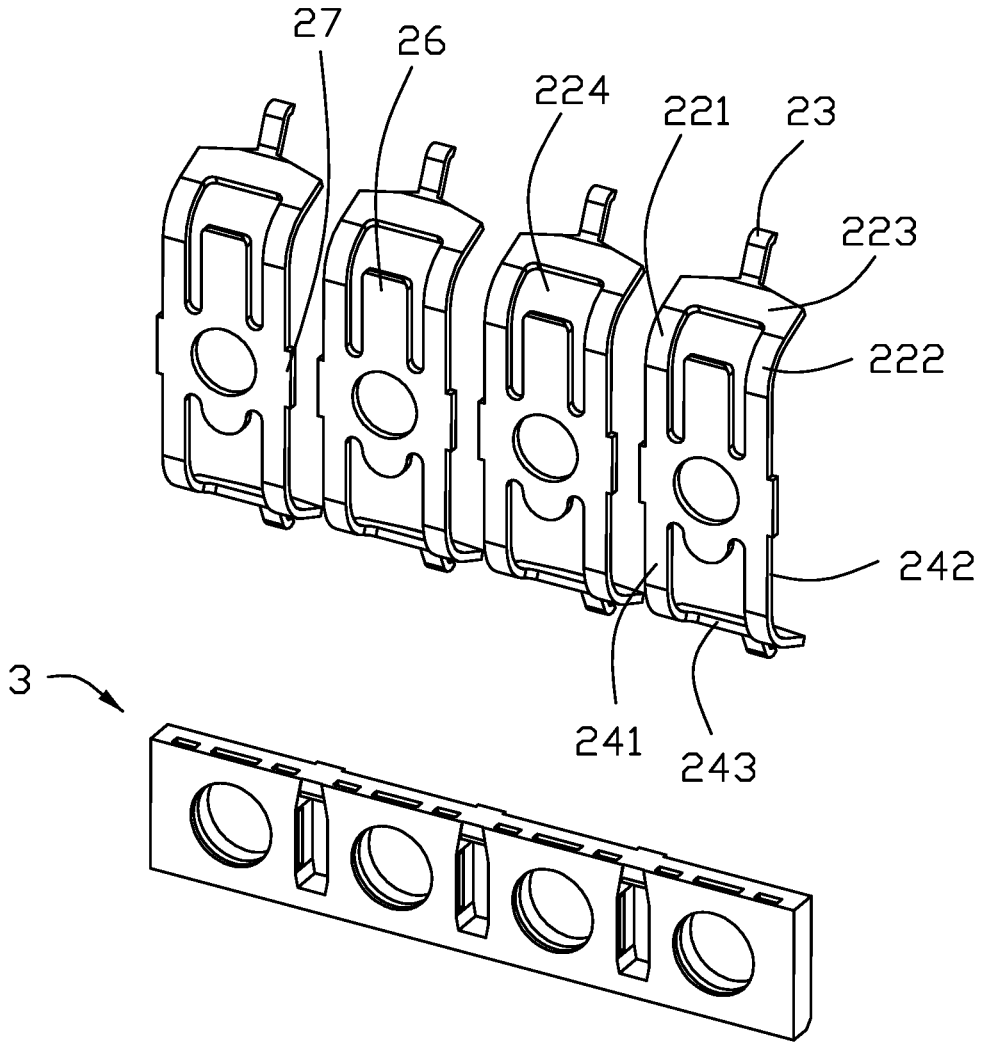
FIG. 9 is another exploded perspective view of the contact module of the electrical connector of FIG. 4.
Figure 10:
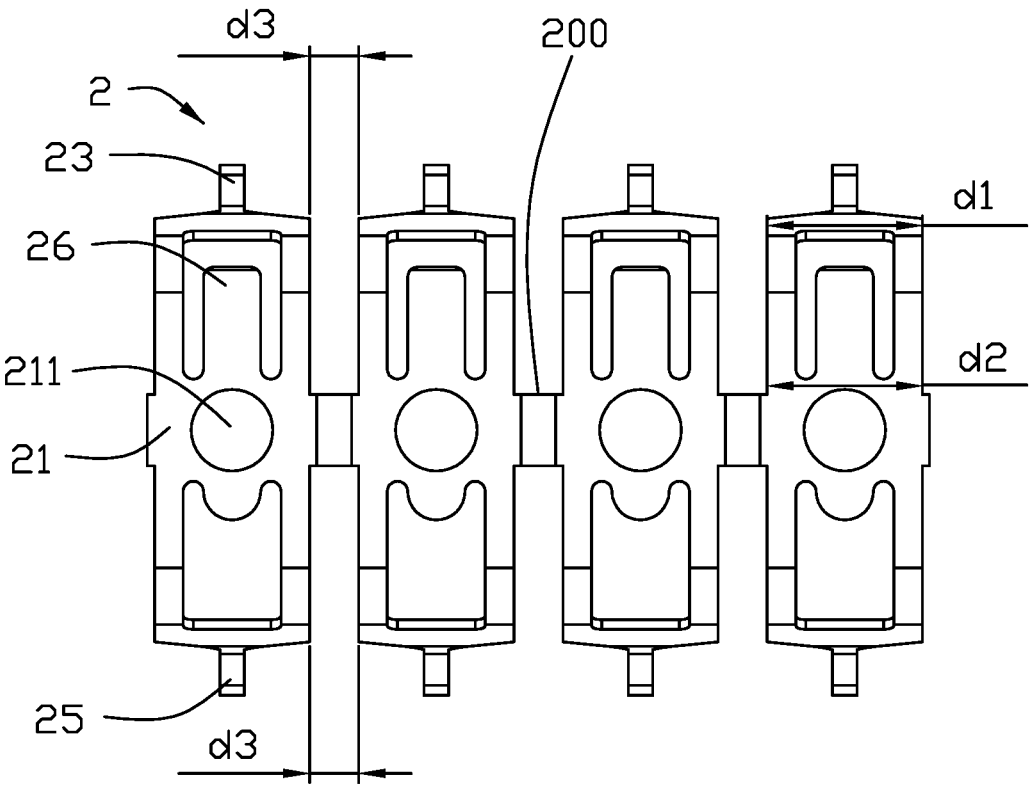
FIG. 10 is an elevational view of the contacts of the contact module of the electrical connector of FIG. 9 before the linking carriers are removed therefrom.
Figure 11:
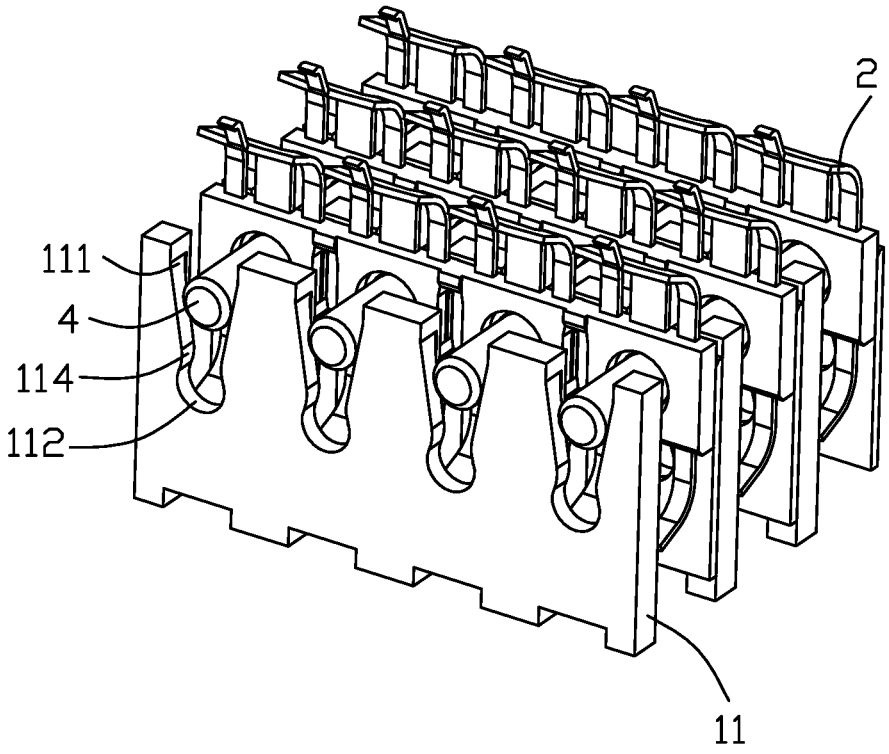
FIG. 11 is a perspective view of the electrical connector of FIG. 1 wherein the contact modules are located at an initial upper position.
Figure 12:
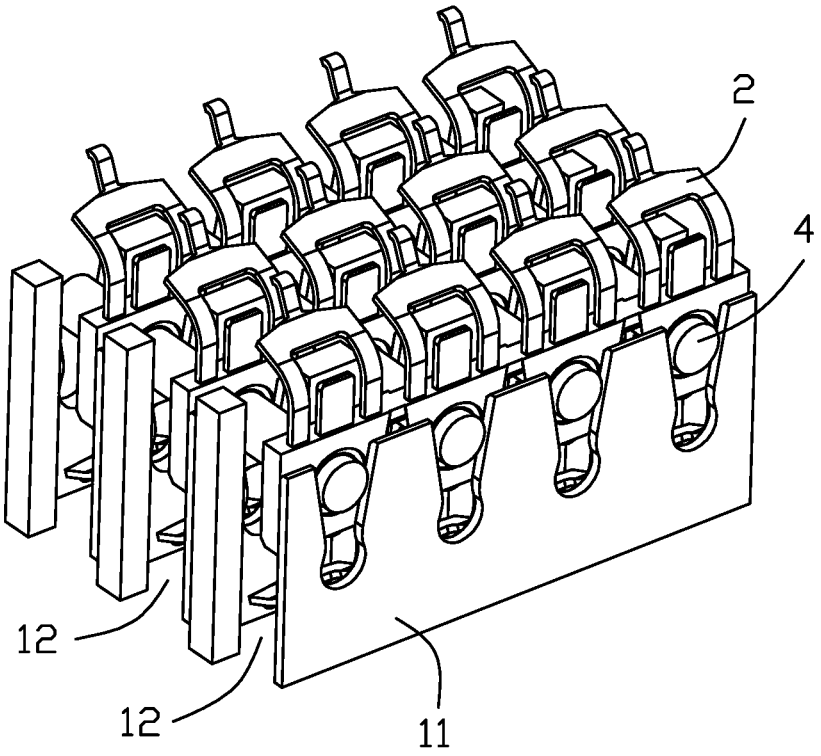
FIG. 12 is another perspective view of the electrical connector of FIG. 11.

The contact 2 is made by sheet metal and includes a planar main body 21, a first/upper spring arm 22 upwardly extending from an upper portion of the main body 21 with a first/upper contacting section 23 at a free end, a second/lower spring arm 24 downwardly extending from a lower portion of the main body 21 with a second/lower contacting section 25 at a free end. The first spring arm 22 defines a first opening 224 therein so as to form a pair of first and second beams 221, 222 located by two sides of the first opening 224 and merged together at the upper/first bridge 223. The first contacting section 23 extends upwardly from the first bridge 223. A holding tab 26 extending from an upper portion of the main body 21 into the opening 224 and between the pair of beams 221, 222. As shown in FIG. 8, along the longitudinal direction, the width defined by the first spring arm 22 is similar to the width defined by the main body 21. The contacts 2 of the same contact module are made from a same metal sheet so as to have the linking carrier 200 between every adjacent two contacts 2 linked with the corresponding connecting sections/edges 27 of the lateral sides of the main bodies 21 thereof. The main body 21 forms an opening 211 for forming the contact module. The width of the first contacting section 23 is smaller than that of the holding tab 26. The first contacting section 23 is aligned with and located above the guiding slot 111.

Similar to the first spring arm 22, the second spring arm 24 forms a second opening 244 with a pair of beams 241, 242 by two side of the second opening 244, and merged together at the second bridge 243 from which the second contacting section 25 downwardly extends. The second contacting section 25 is aligned with and located below the cutout 113. Therefore, the first spring arm 21 and the second spring arm 22 are essentially symmetrically arranged with each other in the vertical direction. Notably, the distance d3 between the corresponding spring arms 22 or 24 of the neighboring contacts 2 is around 0.24 mm which is relatively tiny compared with the traditional design, thus increasing the coupling effect for better signal transmission advantageously.

In each contact module, the insulator 3 encloses the corresponding row of contacts 2. The insulator 3 forms a plurality of openings or apertures 31 aligned with the corresponding linking carriers 200, and a plurality of openings 32 coaxially aligned with the corresponding openings 211 in the transverse direction Y to from a common through hole. Notably, the linking carriers 200 are removed from the contact module via the corresponding opening 31 after insert-molding for separating the neighboring contacts 2.

A plurality of assembling poles 4 extend through the corresponding openings 32 of the contacts 2 and openings 211 of the insulators 3 in the transverse direction, and further retained in the corresponding positioning slots 112. Notably, each contact module is received within the corresponding channel 12. Each assembling pole 4 forms a plurality of ribs 41 extending through the corresponding openings 211 in an interference fit so as to retain the corresponding contact module to the assembling pole 4. After the assembling poles 4 and the corresponding contact modules are assembled together by engagement of the ribs 41 within the corresponding openings 211 as a sub-combination, such a sub-combination is downwardly assembled to the housing 1 by having the assembling poles 4 downwardly extending into the corresponding positioning slots 112 via the corresponding guiding slots 111. Because of the protrusions 114, the assembling poles 4 cannot be easily upwardly withdrawn from the corresponding positioning slots 112. Because a dimension of the positioning slot 112 is slightly larger than that of the pole 4, the pole 4 is retained to the partition 11 in an interference fit without the relative axial movement therebetween in the transverse direction.

In this embodiment, the partitions 11 are not linked with one another in the transverse direction. Anyhow, the partitions 11 may be linked with the transverse walls in the transverse direction for reinforcement of the whole housing 1.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an insulative housing including a plurality of longitudinally extending partitions spaced from each other in a parallel relation to define corresponding channels each extending in a longitudinal direction;

each of said partitions forming a plurality of upwardly exposed guiding slots each with thereof a positioning slot at a bottom in a vertical direction perpendicular to the longitudinal direction; and a plurality of contact modules disposed in the corresponding channels, respectively, each contact module including a row of contacts integrally formed within an insulator via insert-molding and forming a plurality of through holes in a transverse direction perpendicular to both the longitudinal direction and the vertical direction; and a plurality of assembling poles each extending, in the transverse direction, through both the corresponding positioning slots of the partitions and the corresponding through holes of the contact modules for assembling the contact modules to the housing.

2. The electrical connector as claimed in claim 1, wherein the assembling pole and the corresponding positioning slot of the partition are assembled in an interference fit.

3. The electrical connector as claimed in claim 1, wherein the assembling pole and the corresponding through hole of the contact module are assembled in an interference fit.

4. The electrical connector as claimed in claim 3, wherein in each contact module each contact forms an opening coaxially aligned with a corresponding opening formed in the insulator to commonly form said through hole, and the assembling pole is assembled within the opening of the contact in the interference fit.

5. The electrical connector as claimed in claim 4, wherein the assembling pole forms a plurality of ribs to be assembled into the corresponding openings of the contacts of the contact modules in the interference fit.

6. The electrical connector as claimed in claim 1, wherein a pair of protrusions are formed at a joint between the guiding slot and the corresponding positioning slot to restrict upward movement of the assembling pole.

7. The electrical connector as claimed in claim 1, wherein each contact includes an upper spring arm with an upper contacting section extending above an upper surface of the housing and aligned with the corresponding guiding slot in the vertical direction.

8. The electrical connector as claimed in claim 7, wherein each contact further includes a lower spring arm with a lower contacting section extending below a lower surface of the housing and aligned with a corresponding cutout formed in a lower portion of the corresponding partition in the vertical direction.

9. The electrical connector as claimed in claim 1, wherein in each contact module the contacts are laterally linked with one another via corresponding linking carriers in the longitudinal direction, and the insulator forms a plurality openings aligned with the corresponding linking carriers in the transverse direction, respectively, for removing said linking carriers after the insert-molding.

10. The electrical connector as claimed in claim 1, wherein each guiding slot is upwardly divergent toward an exterior.

11. A sub-combination for mounting into an insulative housing comprising:

a plurality of contact modules side by side arranged with one another in a transverse direction, each contact module including one row of contacts integrally formed, via insert-molding, within an insulator extending in a longitudinal direction perpendicular to the transverse direction, each contact including a main body with an opening extending therethrough in the transverse direction and coaxially aligned with corresponding opening formed in the insulator; and a plurality of assembling poles each extending along the transverse direction through the corresponding opening of the contact and the corresponding opening of the insulator of each contact module.

12. The sub-combination as claimed in claim 11, wherein the assembling pole extends through the corresponding opening of the contact in an interference fit.

13. The sub-combination as claimed in claim 11, wherein in each contact module, the contacts are originally linked with one another via corresponding linking carriers along the longitudinal direction, and the insulator forms a plurality of apertures aligned with the corresponding linking carriers in the transverse direction, respectively, for removal of the linking carriers after insert-molding.

14. The sub-combination as claimed in claim 11, wherein each contact further includes an upper spring arm with an upper contacting section at a free end aligned with the corresponding assembling pole in a vertical direction perpendicular to both the longitudinal direction and the transverse direction.

15. A method of making an electrical connector comprising steps of:

forming a plurality of contact modules wherein each contact module includes one row of contacts integrally formed within an insulator via insert-molding, each insulator extends in a longitudinal direction and forms a plurality of through holes in a transverse direction perpendicular to the longitudinal direction;

providing a plurality of assembling poles spaced from one another in the longitudinal direction, wherein each assembling pole extends in the transverse direction; and inserting the assembling poles through the corresponding through holes of said contact modules in an interference fit to form a sub-combination.

16. The method as claimed in claim 15, further including: a step of providing an insulative with a plurality of longitudinally extending partitions parallel to one another with therebetween corresponding channels spaced from one another in said transverse direction, wherein each partition forms a plurality of guiding slots each with an upward exposed positioning slot at a bottom end thereof in a vertical direction perpendicular to both the longitudinal direction and the transverse direction; and a step of downwardly assembling the sub-combination into the housing wherein the contact modules are received within the corresponding channels, respectively, and the assembling poles downwardly pass the corresponding guiding slots and into the corresponding positioning slots.

17. The method as claimed in claim 16, wherein said assembling poles are assembled to the partitions in an interference fit.

18. The method as claimed in claim 17, wherein in each contact module, the contacts are originally linked with one another via corresponding linking carriers along the longitudinal direction, and the insulator forms a plurality of apertures aligned with the corresponding linking carriers in the transverse direction, respectively, for removal of the linking carriers after insert-molding.

19. The method as claimed in claim 18, wherein each contact further includes an upper spring arm with a corresponding upper contacting section at a free end aligned with the corresponding guiding slot in the vertical direction.

20. The method as claimed in claim 19, wherein each guiding slot is upwardly divergent toward an exterior.

* * * * *